US006831608B2

(12) United States Patent
Arvidsson

(10) Patent No.: US 6,831,608 B2
(45) Date of Patent: Dec. 14, 2004

(54) MICROWAVE ANTENNA WITH PATCH MOUNTING DEVICE

(75) Inventor: Per-Anders Arvidsson, Solna (SE)

(73) Assignee: Allgon AB, Taby (SE)

( * ) Notice: Subject to any disclaimer, the term of this patent is extended or adjusted under 35 U.S.C. 154(b) by 28 days.

(21) Appl. No.: 10/416,162

(22) PCT Filed: Oct. 26, 2001

(86) PCT No.: PCT/SE01/02357

§ 371 (c)(1),
(2), (4) Date: May 15, 2003

(87) PCT Pub. No.: WO02/43183

PCT Pub. Date: May 30, 2002

(65) Prior Publication Data

US 2004/0027290 A1 Feb. 12, 2004

(30) Foreign Application Priority Data

Nov. 27, 2000 (SE) ..... 0004354

(51) Int. Cl.[7] ..... H01Q 1/38
(52) U.S. Cl. ..... 343/700 MS; 343/702
(58) Field of Search ..... 343/700 MS

(56) References Cited

U.S. PATENT DOCUMENTS

| | | | | | |
|---|---|---|---|---|---|
| 4,443,802 | A | * | 4/1984 | Mayes | 343/729 |
| 5,801,660 | A | | 9/1998 | Ohtsuka et al. | 343/700 |
| 6,020,852 | A | * | 2/2000 | Jostell | 343/700 MS |
| 6,236,367 | B1 | | 5/2001 | Du Toit et al. | 343/700 |
| 6,369,761 | B1 | * | 4/2002 | Thiam et al. | 343/700 MS |
| 6,735,849 | B2 | * | 5/2004 | Cheng et al. | 29/600 |

FOREIGN PATENT DOCUMENTS

| | | |
|---|---|---|
| WO | WO97/43799 | 11/1997 |
| WO | WO99/31757 | 6/1999 |

* cited by examiner

*Primary Examiner*—James Vannucci
(74) *Attorney, Agent, or Firm*—Jacobson Holman PLLC

(57) ABSTRACT

A microwave antenna with a simple mounting device for a dielectric plate and a radiating patch is described. The mounting device includes a column, which is secured to a housing at its lower end and extends centrally through a coupling aperture in the dielectric plate up to an aligned opening in the patch. The patch and the plate are held in well-defined positions in relation to the housing and at a mutual distance from each other.

9 Claims, 3 Drawing Sheets

MICROWAVE ANTENNA WITH PATCH MOUNTING DEVICE

This is a nationalization of PCT/SE01/02357 filed Oct. 26, 2001 and published in English.

FIELD OF THE INVENTION

The present invention relates to a microwave antenna with at least one mounting device for securing a radiating patch on the antenna. The antenna is of the kind including a radiating patch of an electrically conductive material, a housing of rigid material, a dielectric plate, an electrically conductive layer serving as a ground plane on an upper side of said dielectric plate, said conductive layer having a centrally located coupling aperture, and a feeding network on the other, lower side of said dielectric plate for feeding microwave power to said radiating patch via said coupling aperture.

RELATED ART AND BACKGROUND OF THE INVENTION

Antennas of this general kind are disclosed in e.g. WO 97/43799 (Allgon AB) and WO 99/31757 (Allgon AB). Both these known antennas operate with dual polarisation obtained by forming the coupling aperture as a pair of slots crossing each other at right angles. The latter document also discloses a double patch arrangement for dual band operation.

A practical problem, which is not dealt with in these two documents, is to provide a structure which enables a swift mounting of the dielectric plate and the associated radiating patch or patches on the antenna. For the proper operation of the antenna, the plate and the patch or patches must be secured in well-defined positions in order to meet the specified radiation characteristics. Moreover, in antennas operating with dual polarisation, it is important to maintain an effective isolation between the two separate channels.

SUMMARY OF THE INVENTION

The main object of the present invention is to provide a microwave antenna with a simple mounting device, which permits an easy and quick assembly of the antenna and which secures the various components, in particular the dielectric plate and the radiating patch, in well defined positions.

This main object is achieved for an antenna having the features defined in claim 1. Accordingly, the patch and the dielectric plate have mutually aligned holes located centrally in the patch and in the plate, respectively, and the mounting device comprises a mounting column, which is secured to the housing at its lower end. The column extends centrally through the coupling aperture of the ground plane layer and in alignment with the mutually aligned holes of the patch and the plate. The column is secured to the patch at its upper end. In this way the patch and the plate are held in well-defined positions in relation to the housing and at a mutual distance from each other.

With such a structure, the mounting operation is very simple. First, the column is secured to or formed integrally with the housing at a central location, so as to stand upright thereon. Then, the dielectric plate with the feeding network and the ground plane layer is threaded onto the column, whereupon the patch is secured to the top of the column by means of a fastening screw. Alternatively, the mounting column may be formed as a relatively long screw extending through the holes of the patch and the plate and being in threaded engagement with the housing at its lower end.

The patch is preferably held at a distance from the plate by means of spacing elements defining the mutual distance therebetween. In a particularly advantageous embodiment, the patch and the plate are held together by the spacing elements and are mounted as a unit onto the housing.

Preferably, the patch and the plate are clamped-together against the housing so as to be securely positioned when the patch is secured to the upper end of the mounting column.

The mounting column may extend freely through the plate and the coupling aperture, which makes it possible to locate the plate in an exact position on the housing when being clamped thereon.

It has turned out that the central column and the aligned holes in the patch and the plate do not have a negative influence on the radiation characteristics of the antenna.

These and other features will be apparent from the detailed description below and the appended claims.

BRIEF DESCRIPTION OF THE DRAWINGS

The invention will now be described further below with reference to the drawings illustrating a preferred embodiment.

DETAILED DESCRIPTION OF A PREFERRED EMBODIMENT

Figure 1:
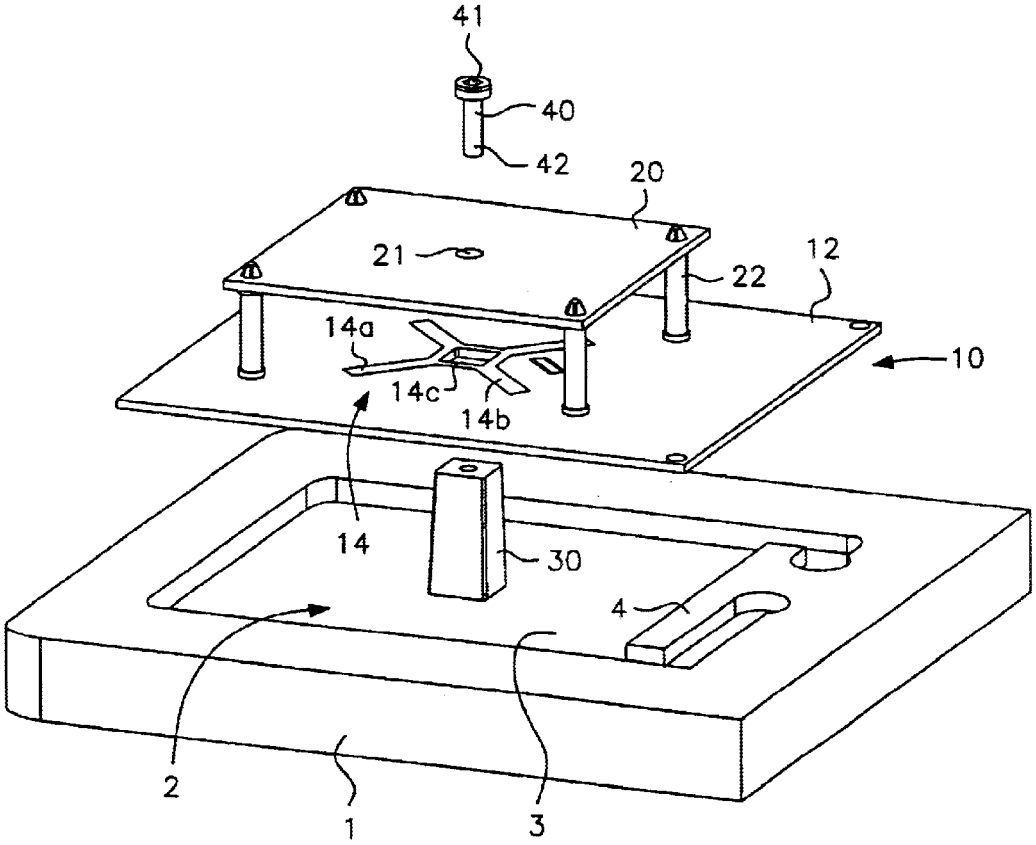
FIG. 1 shows in a perspective, exploded view the basic parts of a microwave antenna according to the invention.

In FIG. 1, only those parts of the antenna are shown which are essential for the understanding of the invention, whereas a number of mechanical and electrical parts are left out for the sake of clarity.

At the bottom of FIG. 1, there is shown a housing 1 of a rigid, metallic material, e.g., of aluminium. In this embodiment there is shown a single antenna element (at the top of FIG. 1). It should be understood that the antenna according to the invention may include several antenna elements, e.g. located in a linear row or in an array.

Figure 2:
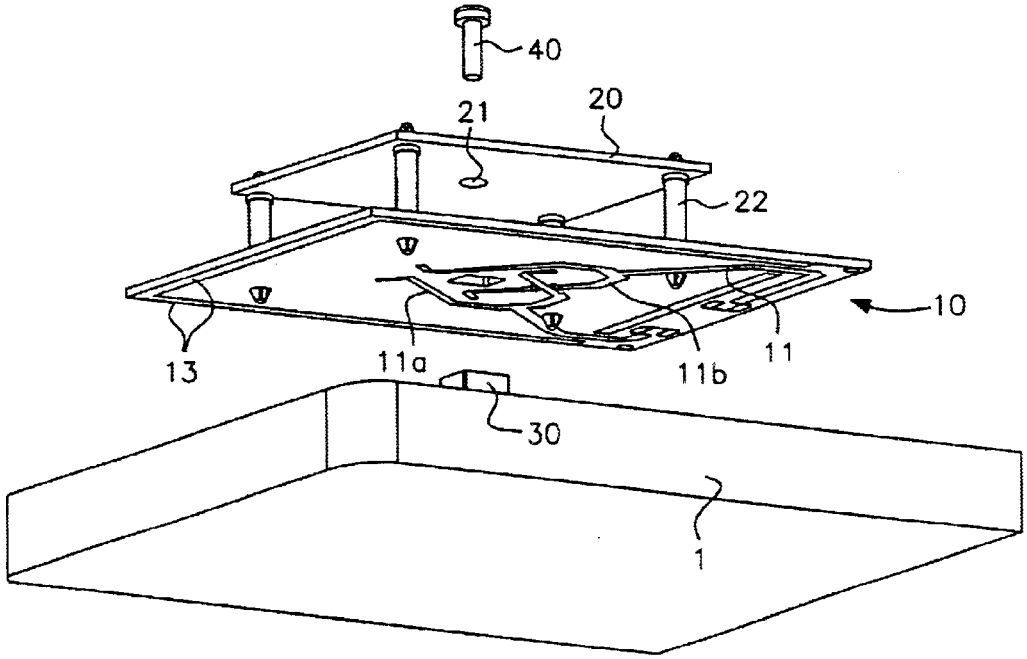
FIG. 2 shows the antenna according to FIG. 1 in a perspective view from below.

The housing 1 has a central recess 2 having a rectangular configuration and a bottom wall 3. At one side wall of the recess 2, there is a housing portion 4 projecting into the recess 2. This portion 4 serves to carry a fitting (not shown) for connecting one or more feed cables or feed conduits (not shown) to a feeding network 11 on the lower side of a dielectric plate 10. See also FIG. 2.

Figure 3:
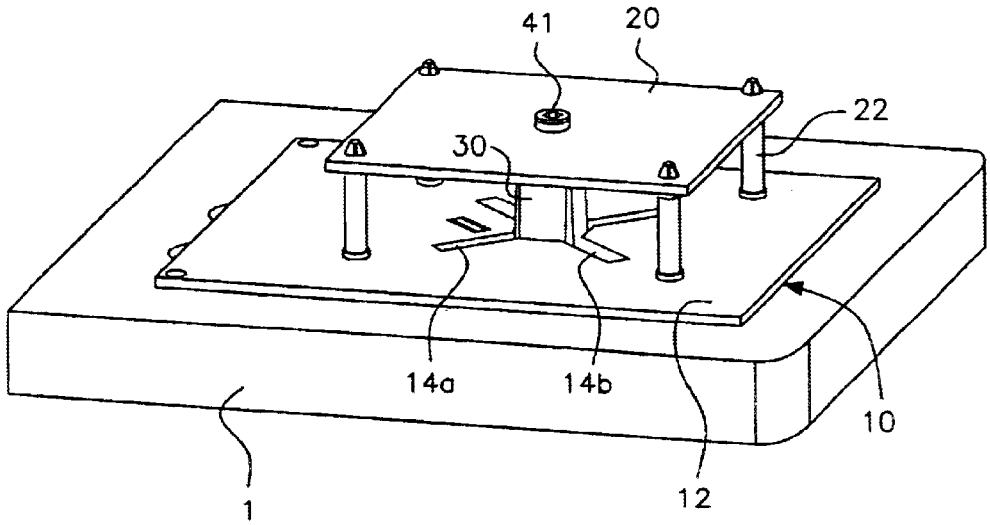
FIG. 3 shows the antenna of FIG. 1 upon assembly.

The dielectric plate 10, which is rectangular and somewhat larger than the rectangular area of the recess 2, is provided with an electrically conductive layer 12 on its opposite upper side. This conductive layer 12 serves as a ground plane for the antenna and is coupled to conductive strips 13 extending along the peripheral edge portions on the lower side of the dielectric plate 10. In this way, upon assembly of the device as shown in FIG. 3, the ground plane layer 12 will be electrically coupled to the housing 1, which also serves as a reflector for the antenna.

Microwave power is fed via the feed network 11 and a coupling aperture 14, located centrally in the ground plane layer 12, to an upper, radiating patch 20. The patch 20 is also rectangular and centered in relation to the recess 2 and the dielectric plate 10.

The radiating patch 20 is made of an electrically conducting material, possibly in the form of a coating on a dielectric substrate.

In the illustrated preferred embodiment, the coupling aperture 14 is formed as a pair of rectilinear slots 14*a*, 14*b* oriented at right angles to each other, so as to provide for double polarisation of the microwave power radiated form the patch 20. Each slot 14*a*, 14*b* is fed by an associated feed element 11*a*, 11*b* of the feed network 11, as is previously known per se.

At the crossing point of the slots 14*a*, 14*b*, the aperture 14 is widened somewhat so as to form a central hole 14*c*. In this embodiment, the hole 14*c* has a substantially square shape and is dimensioned to freely receive a mounting column 30.

The radiating patch 20 and its substrate, if any, has a central hole 21 which is aligned with the hole 14*c* of the dielectric plate 10 and the mounting column 30. The hole 21 is dimensioned to receive, preferably with some play, a screw 40. The screw 40 has a screw head 41 and is dimensioned to engage with its threads 42 in a threaded hole 31 at the top of the mounting column 30. The column 30 is preferably made of metal so as to provide a rigid support for the plate and the patch.

The patch 20 is held at a predetermined distance from the dielectric plate 10 by means of four spacing elements 22 of plastic material. These spacing elements 22 ensure that the patch 20 and the plate 10 are spaced a predetermined distance from each other. Also, by way of snap-fitting into associated holes in the patch and the plate, they hold the patch and the plate together as a unit.

The unit formed by the patch 20 and the plate 10 is brought onto the central mounting column 30. Next, the dielectric plate 10 is fitted exactly onto the housing, with the edge portion adjacent to the recess 2 in this way, the ground plane layer on the dielectric plate 10 will be electrically coupled to the metallic housing 1. By applying a certain torque to the screw 40, the plate 10 will be clamped against the housing 1 by the intermediary of the patch 20 and the spacing elements 22. The complete assembly is illustrated in FIG. 3.

It is to be noted that the central mounting column 30, in spite of its massive dimensions, hardly has any influence on the transfer of microwave power from the feed network to the radiating patch. Nor does it seriously affect the radiation characteristics of the antenna.

Of course, the assembly or mounting operation is greatly facilitated by the structure described above. Moreover, the freely mounted radiating patch 20 will serve as a cooling device. Heat generated in the plate 10 or in other parts staying in thermal contact with the housing 1, will be dissipated via the mounting column 30 to the patch 20.

In principle, the patch and the plate may have a different configuration than rectangular. It could be generally polygonal, circular, elliptical or otherwise symmetrical with regard to the central axis of the mounting column. Moreover, the spacing elements 22 may be replaced by a cylindrical body of a dielectric material.

In this disclosure, the definitions "upper" and "lower" relate to the drawings. Of course, the antenna may be oriented differently in use, and these definitions then have to be understood accordingly.

What is claimed is:

1. A microwave antenna with at least one mounting device for securing a radiating patch on the antenna, said antenna including:

a radiating patch (20) of an electrically conductive material, a housing (1) of a rigid material, a dielectric plate (10), an electrically conductive layer (12) serving as a ground plane on an upper side of said dielectric plate, said conductive layer having a centrally located coupling aperture (14), and a feeding network (11) on the other, lower side of said dielectric plate for feeding microwave power to said radiating patch via said coupling aperture, characterized in that said patch (20) and said dielectric plate (10) have mutually aligned holes (21,14*c*) located centrally in said patch and in said plate, respectively, and said mounting device comprises a mounting column (30), which is secured to said housing (1) at its lower end, so as to extend centrally through said coupling aperture (14) and in alignment with said mutually aligned holes (21,14*c*) of said patch and said plate, and said mounting column (30) is secured at its upper end to said patch (20), so as to hold said patch (20) and said plate (10) in well-defined positions in relation to said housing (1) and at a mutual distance from each other.

2. The antenna as defined in claim 1, wherein said mounting column (30) is secured at its lower end to said housing (1) and reaches all the way to a lower side of said patch (20), and said patch (20) is secured to said mounting column (30) by means of a fastening screw (40) with a screw head (41) clamped onto an upper side of said patch.

3. The antenna as defined in claim 1, wherein said patch (20) is held at a distance from said plate by means of spacing elements (22) defining said mutual distance.

4. The antenna as defined in claim 3, wherein said patch (20) and said plate (10) are held together by said spacing elements (22) and are mounted as a unit onto said housing (1).

5. The antenna as defined in claim 3, wherein said patch (20) and said plate (10) are clamped together against said housing (1) so as to be securely positioned.

6. The antenna as defined in claim 5, wherein said mounting column (30) extends freely through said plate (10) and said coupling aperture (14).

7. The antenna as defined in claim 1, wherein said coupling aperture (14) comprises two mutually orthogonal slots (14*a*, 14*b*) crossing each other at a central location, where the aperture (14*c*) is dimensioned to receive said mounting column (30).

8. The antenna as defined in claim 1, wherein said housing (1) has a recess (2) for accommodating said feeding network, a peripheral portion of said plate (10) being clamped onto said housing (1) outside said recess (2).

9. The antenna as defined in claim 8, wherein said peripheral portion of said plate (10) has a metal contact strip (13) on a lower side contacting said housing (1), said contact strip being electrically coupled to said ground plane layer (12) on the opposite, upper side of said plate (10), so that said housing forms an electrical extension of said ground plane layer.

* * * * *